US008366884B2

(12) United States Patent
Lukkarila et al.

(10) Patent No.: US 8,366,884 B2
(45) Date of Patent: Feb. 5, 2013

(54) PLATING APPARATUS WITH DIRECT ELECTROLYTE DISTRIBUTION SYSTEM

(75) Inventors: Teppo M. Lukkarila, Wallingford, CT (US); Sergey Y. Yesilevich, Meriden, CT (US)

(73) Assignee: Alcatel Lucent, Paris (FR)

( * ) Notice: Subject to any disclaimer, the term of this patent is extended or adjusted under 35 U.S.C. 154(b) by 1315 days.

(21) Appl. No.: 12/112,829

(22) Filed: Apr. 30, 2008

(65) Prior Publication Data

US 2009/0272644 A1 Nov. 5, 2009

(51) Int. Cl.
*C25D 15/00* (2006.01)

(52) U.S. Cl. ..... 204/232; 204/237

(58) Field of Classification Search ..... 204/237, 204/232

See application file for complete search history.

(56) References Cited

U.S. PATENT DOCUMENTS 3,661,732 A * 5/1972 Withrow ..... 205/100
6,350,361 B1 * 2/2002 Sexton et al. ..... 205/82
6,821,407 B1 * 11/2004 Reid et al. ..... 205/292
2006/0046121 A1 * 3/2006 Shimohira et al. ..... 429/30
2010/0104913 A1 * 4/2010 Yamauchi et al. ..... 429/30

* cited by examiner

*Primary Examiner* — Luan Van
(74) *Attorney, Agent, or Firm* — Kramer & Amado P.C.

(57) ABSTRACT

A plating apparatus with direct electrolyte distribution system, including one or more of the following: an electrolyte tank; an electrolyte distribution compartment within the electrolyte tank, the electrolyte distribution compartment for containing electrolyte, the electrolyte distribution compartment having a first side and a second side; a pump having a fluid connection to the electrolyte distribution compartment for applying pressure to the electrolyte; a plurality of nozzles connected to the first side of the electrolyte distribution compartment, the electrolyte being forced through the plurality of the nozzles from the electrolyte distribution compartment to a part to be plated when the pump applies pressure to the electrolyte in the electrolyte distribution compartment; an electrolyte collection compartment within the electrolyte tank, the electrolyte collection compartment being in fluid communication with the electrolyte distribution compartment; and a removable screen between the electrolyte collection compartment and the second side of the electrolyte distribution compartment.

20 Claims, 5 Drawing Sheets

PLATING APPARATUS WITH DIRECT ELECTROLYTE DISTRIBUTION SYSTEM

BACKGROUND OF THE INVENTION

1. Field of the Invention

This invention relates generally to coating or plating a surface of an object with an electrolyte.

2. Description of Related Art

Coating or plating a surface of a substance with an electrolyte, or electroplating, has evolved. There are an ever-increasing number and widening types of applications of this branch of practical science and engineering. Some of the technological areas in which this is applied include macro-electronics, microelectronics, optics, optical-electronics, and sensors of most types. There are many other technological areas where electroplating is used.

Some industries use electroplating instead of other options. For example, the automobile industry uses chrome plating instead of evaporation, sputtering, chemical vapor deposition (CVD) and the like, to enhance the corrosion resistance of metal parts. Reasons for using electroplating include both economy and convenience.

By way of illustration it should be noted that that modern electroplating equips the practitioner with the ability to pre-design the properties of surfaces. In the case of electroforming this includes the properties of the whole part. Furthermore, the ability to deposit very thin multi-layers less than a millionth of a centimeter in thickness via electroplating is available.

Electroplating is often also called "electro-deposition," and the two terms are used interchangeably. Electroplating occurs by electro-deposition, producing a coating, usually metallic, on a surface by the action of electric current. The deposition of a metallic coating onto the surface of an object is achieved by putting a negative charge on the object to be coated and immersing it into a solution, which contains a salt of the metal to be deposited.

In other words, the object to be plated functions as a cathode of an electrolytic cell. The metallic ions of the salt carry a positive charge and are thus attracted to the object. When they reach the surface of the negatively charged object that is to be electroplated, that object provides electrons to reduce the positively charged ions to metallic form.

In connection with electro-plating, many applications have a limited tolerance of the thickness of the plating formed by electroplating. Thus, it is desirable to control the thickness of the plating formed by electro-plating within a pre-determined tolerance.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation that may be apparent to those skilled in the art. Accordingly, the present invention resides in the novel methods, arrangements, combinations, and improvements herein shown and described in various exemplary embodiments.

SUMMARY OF THE INVENTION

In light of the present need for a plating apparatus with a direct electrolyte distribution system, a brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

It is believed that current solutions do not provide an even plating thickness, or control the thickness effectively where plating is needed. It is believed that this is especially true for housings with deep cavities. Most of the metal plating stays on the top of the housing or on the wall but not on the bottom of the housing. Unfortunately, the bottom of the housing is believed to be pertinent to good plating.

Some current approaches use shading of parts or special anodes. Unfortunately, this limits process capability and narrows process control. These flaws are believed to make the plating process very unstable. Accordingly, various exemplary embodiments, prevent plating thickness of an uncontrolled variability. Likewise, various exemplary embodiments improve plating process and plated parts quality control.

In order to achieve one or more of the foregoing objectives, various include a special compartment inside of a plating tank. In various exemplary embodiments, this provides a controlled agitation of the electrolyte and delivers fresh electrolyte to more precisely defined areas that need to be plated the most.

Various exemplary embodiments provide direct controlled distribution of the electrolyte. Various exemplary embodiments control plating velocity at controlled areas of a part or parts being plated. Various exemplary embodiments achieve this using a special compartment with connected pump.

In various exemplary embodiments, the special compartment has nozzles on one side, a membrane for electrolyte flow, and an electrical contact with the anode or anode compartment on the opposite side. The membrane is supported by a perforated screen so electrolyte distribution and the anode compartments or the anode are electrically connected to provide continuous and controlled solution flow and plating.

In various exemplary embodiments, nozzles placed on the high-pressure side of the electrolyte distribution compartment can be removed, replaced, closed or blocked to provide an effective electrolyte distribution to the surface of the part being plated. Accordingly, various exemplary embodiments replicate the surface of the part being plated through electrolyte distribution in an effective manner.

In various exemplary embodiments, the electrolyte distribution compartment is adjustable to acquire the thickness of the part. Likewise, in various exemplary embodiments, the electrolyte distribution compartment is adjustable to provide surface details through an effective electrolyte flow to the part(s) being plated.

Some current electrolytic coating and plating processes are designed to apply universally to all plated parts without being adjustable or flexible to the variable form of the part(s). Likewise, the distance(s) between different level(s) inside part such as upper walls, resonators and lower inner surfaces are treated universally in some current electrolyte coating and plating processes. It is believed to be beneficial for many of the plated parts to have variable levels of surfaces. However, this makes the distance between electrodes uncontrollable and hard to adjust in current embodiments. This affects the thickness of the coating on different areas of the part. In turn, this leads to excess plating on surfaces that are closer to the anode than other surfaces.

In many current embodiments, all plating equipment stays the same general design for all parts being coated. Many current embodiments use simple settings to plate parts with little consideration of their difference in terms of depth and interactive surfaces. This is believed to affect plating quality in many instances.

In many current embodiments, the most plated metals electrolytic deposit stays on surface(s) that are closer to opposite electrodes. Accordingly, it is believed that areas more desirable to be plated get two to three times less deposit than desired. It is believed that this creates a need to extend timing and electrode distances for plating parts with complicated surfaces. This in turn leads to over-plating at some areas, more voltage between electrodes, and narrowing the window for process parameters control.

This is also believed cause the thickness of the part in different areas and the cost of the process to become uncontrollable. Most plating gets on top of the part. This is undesirable, and might result in closing open mounting holes, creating unwanted build-ups, and creating excessive roughness at some areas. The foregoing all results in lowering a usability of the part being plated.

The walls and build-in parts shade the area of importance for parts used in radio frequency applications. This affects electrolyte circulation inside the part, making external ion delivery to the plated surface the slowest stage of the process and the major process control stage. As a result the bottom of the part that is located further from the anode than the top of the part will have less plating than desired to achieve performance specifications for the part. Improving electrolyte circulation in the area of interest, as close to the surface of the part as possible, will improve thickness equity on all surfaces while maintaining minimally desired thicknesses on specified areas.

BRIEF DESCRIPTION OF THE DRAWINGS

In order to better understand various exemplary embodiments, reference is made to the accompanying drawings, wherein.

DETAILED DESCRIPTION OF THE PREFERRED EMBODIMENTS OF THE INVENTION

Figure 1:
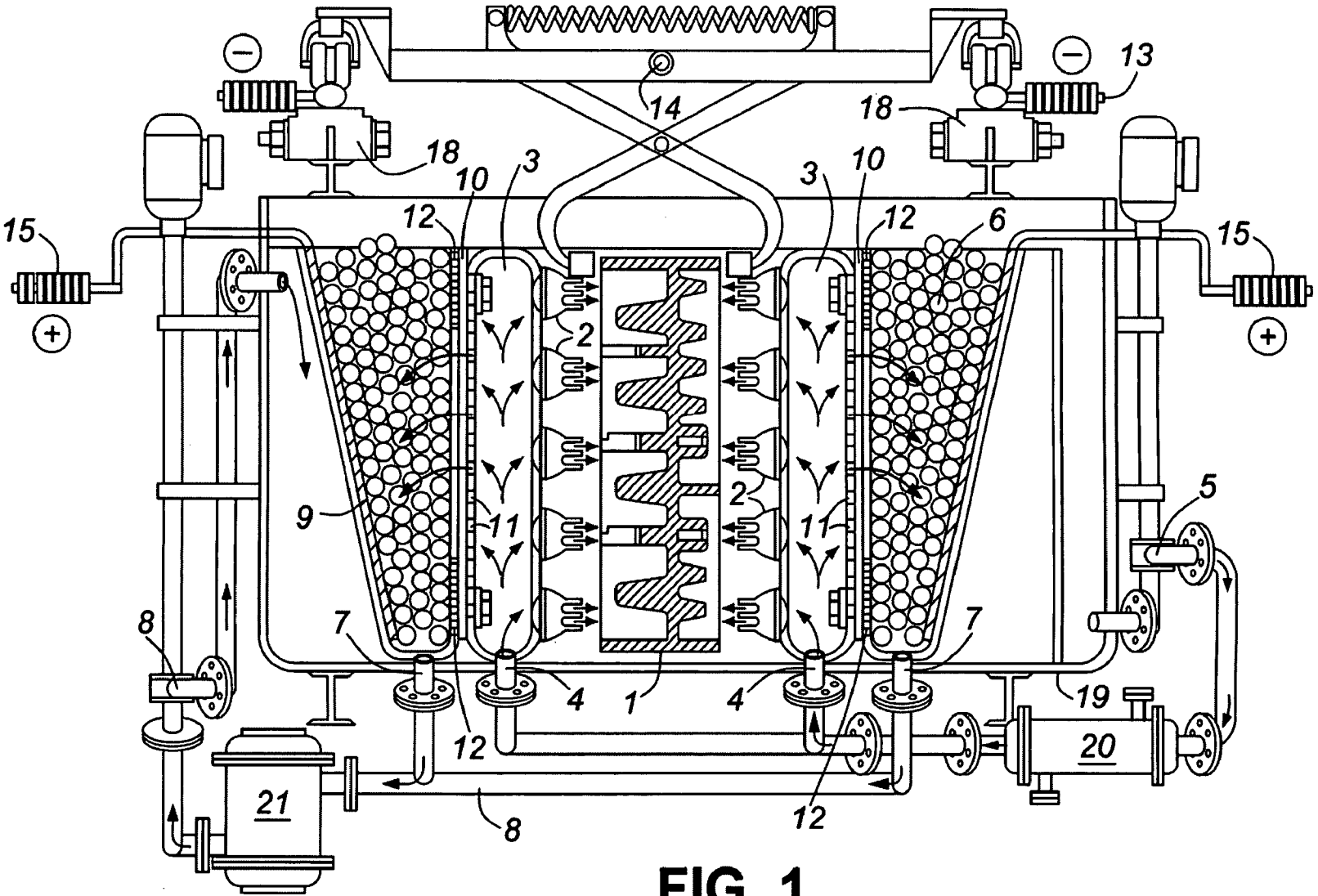
FIG. 1 is a partially schematic, partially cross-sectional view of a first exemplary embodiment of a plating apparatus with direct electrolyte distribution system.

Referring now to the drawings, in which like numerals refer to like components or steps, there are disclosed broad aspects of various exemplary embodiments.

FIG. 1 is a partially schematic, partially cross-sectional view of a first exemplary embodiment of a plating apparatus with direct electrolyte distribution system.

The plated part (1), or two parts combined and racked together, is placed in the center of the plating bath next to or between positively charged electrodes, anodes (6). The apparatus is filled with electrolyte. The level of the electrolyte is controlled by the height of a leveled wall or by any other method.

Figure 2:
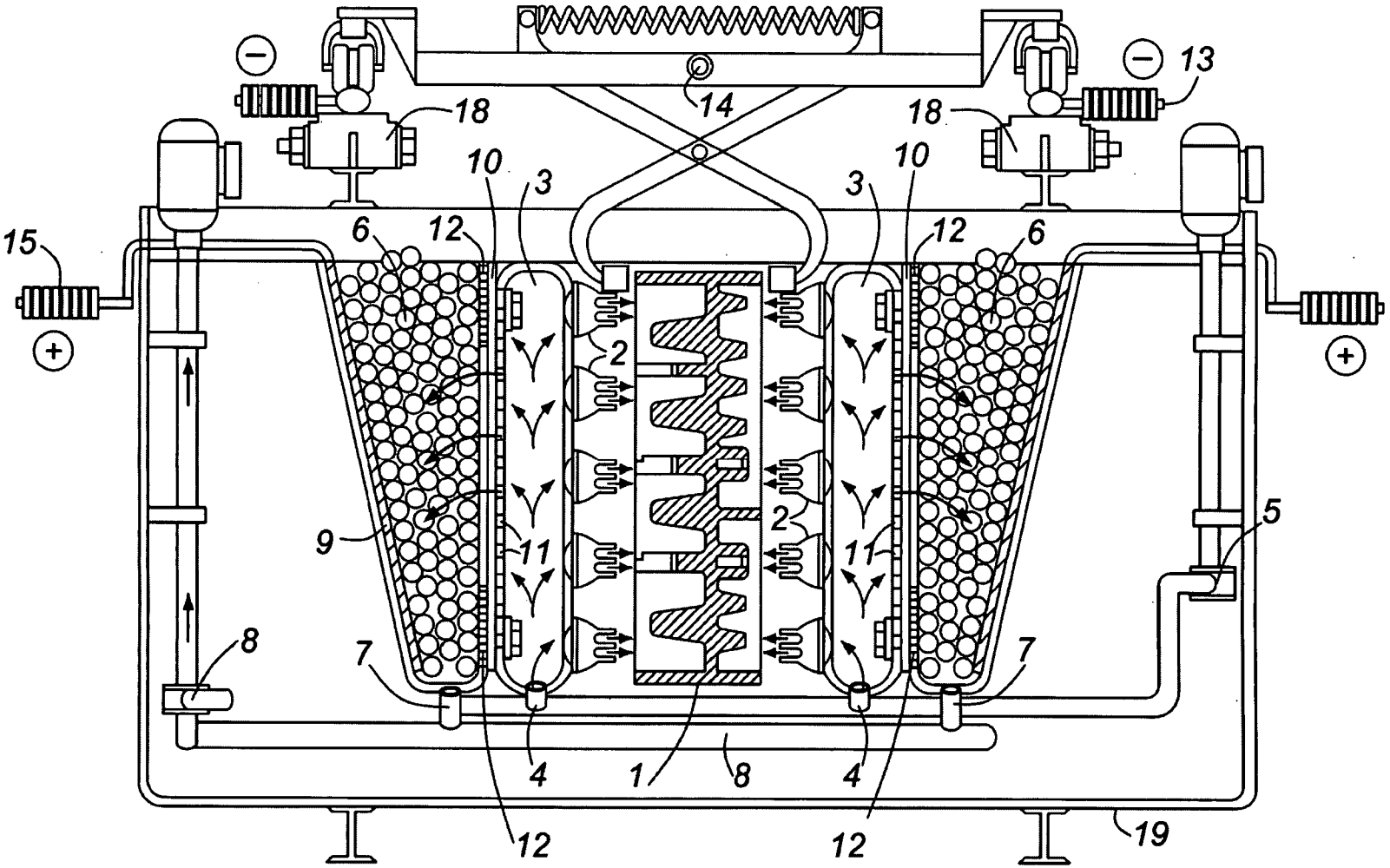
FIG. 2 is a partially schematic, partially cross-sectional view of a second exemplary embodiment of a plating apparatus with direct electrolyte distribution system.
Figure 3:
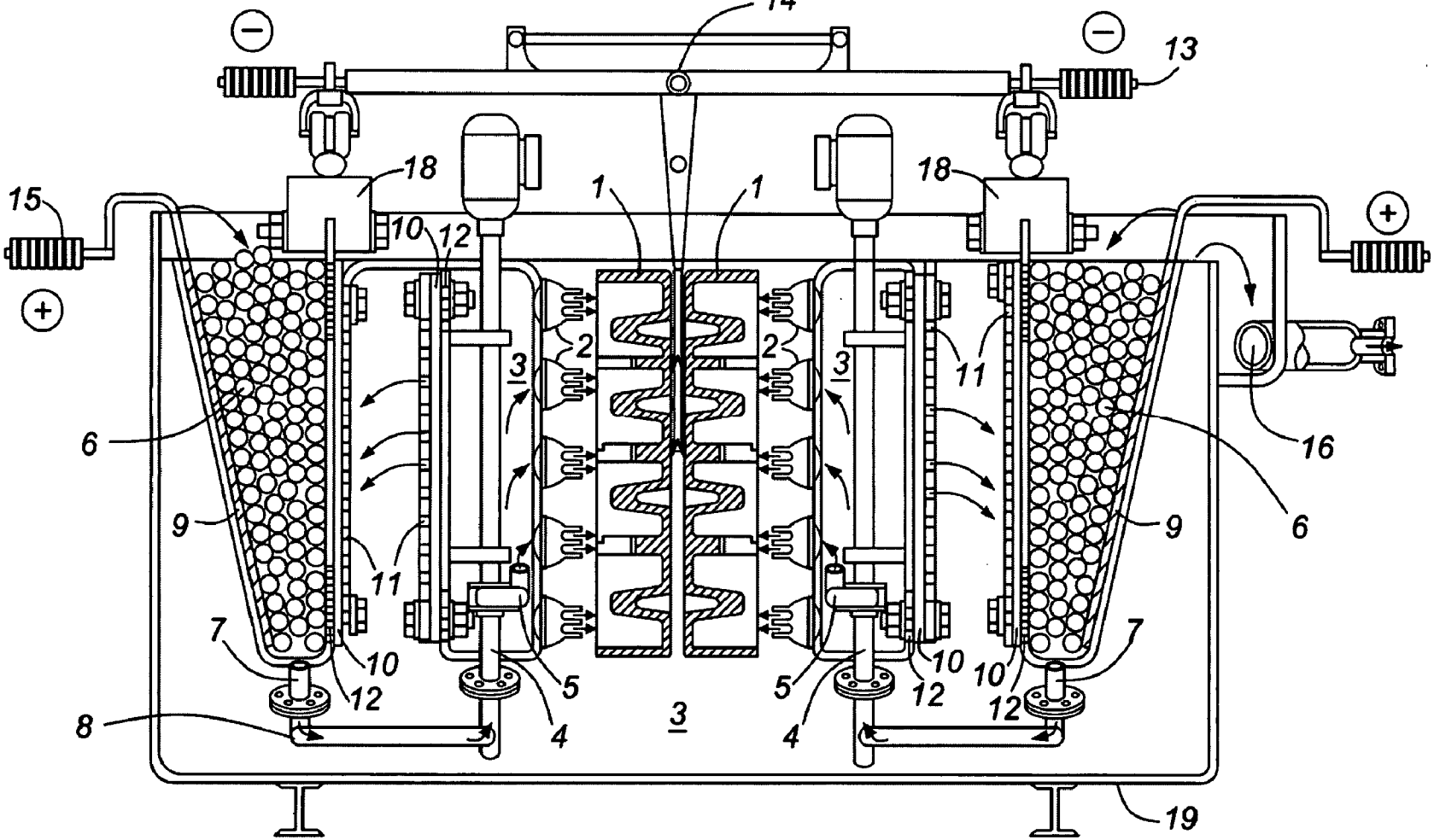
FIG. 3 is a partially schematic, partially cross-sectional view of a third exemplary embodiment of a plating apparatus with direct electrolyte distribution system.
Figure 4:
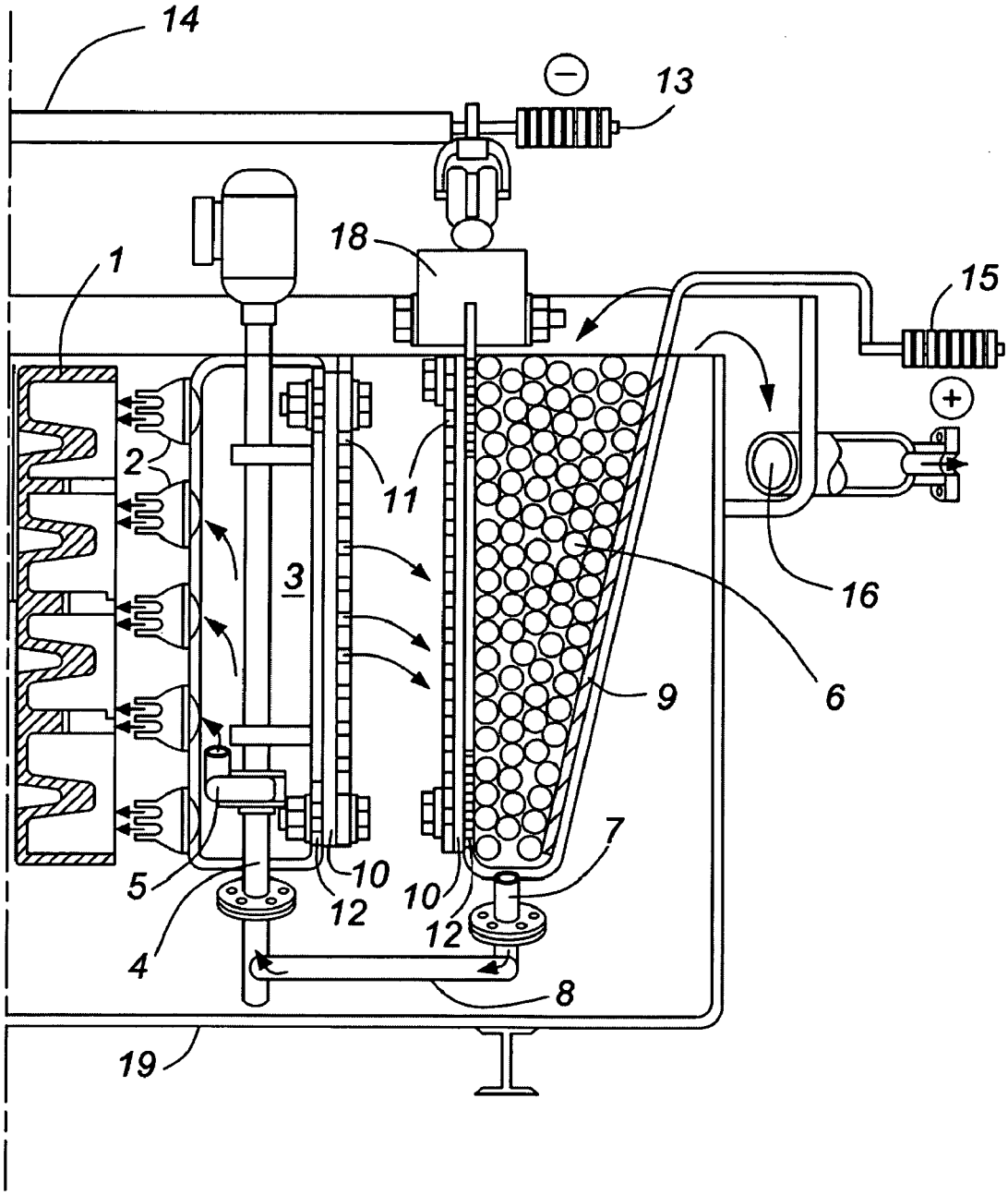
FIG. 4 is a partially schematic, partially cross-sectional, fragmented view of the third exemplary embodiment of a plating apparatus with direct electrolyte distribution system according to FIG. 3.

In various exemplary embodiments, overflow of electrolyte, if needed for electrolyte flow control, is collected in a special compartment (16) and pumped back by pump (5) into specially designed collector-distributor (3). This is shown in FIG. 3 and FIG. 4. In the embodiments of FIG. 1 and FIG. 2, the system is all connected such that it does not have a separate overflow. Rather, in the embodiments of FIG. 1 and FIG. 2 the overflow goes out to the same collective system.

Pump (5) is adjustable or has a valve in various exemplary embodiments. Pump (5) regulates flow inside the apparatus and agitates electrolyte inside the plated part providing even distribution of equally concentrated electrolyte to all surfaces of the plated part. The steady direct flow eliminates air pockets or other obstructions for plating.

Parts are placed inside tank (19) on a stable or moving rack (18) with electrical contact system (13). Electrical contact system (13) provides equal distribution of electrical current density to all plated surfaces. In various exemplary embodiments, the racking system (18) has rollers or wheels to provide movement for the plated part through the tank while the part has been plated. In various exemplary embodiments, the racking system (18) includes small rails, a conveyor belt, electrical contact rails, and in and out monolith, and so on. The racking system is either automatic or manual.

Anode material (6) is placed into special compartment (9) separated from other tank space by a conductive metal plate on one side and a perforated non-conductive plate (12) with a special membrane (10) to isolate anode material (6) from electrolyte. This arrangement also provides a steady flow of electrolyte through the anode material (6) in various exemplary embodiments.

The anode (6) is made of either a disposable or a non-disposable material. Perforated sheet (12) and membrane (10) hold the anode material (6) intact inside the compartment providing good electrical contact with a conductive plate or solid sheet metal alloy located at the back side of anode (9).

In various exemplary embodiments, the anode compartment has another electrode made of non-disposable material to improve oxidation of the anode material (6) and prevent its passive state by product of anode dissolving and salts. The conductivity plate is preferably fabricated from a non-disposable metal that is insoluble in electrolyte. This provides good electrical contact with anode material (6).

In various exemplary embodiments, electrolyte is pumped into collector-distributor (3) with specially formed or installed nozzles (2) to agitate the electrolyte inside the plated part. The electrolyte is partially pushed through the perforated plate and anode membrane by a special pump. Alternatively, the electrolyte is pushed by the same electrolyte intake pump to agitate the anode space and enrich electrolyte with newly dissolved ions. Anode material is loaded in and maintained through the open top of the anode compartment in various exemplary embodiments.

In various exemplary embodiments, about 50-95% of the electrolyte that is pumped into the electrolyte distribution compartment (3) is directed into parts to be plated. About 5-50% of the whole amount of electrolyte pumped into the electrolyte distribution compartment is directed through anode compartment (9) by an anode agitation pump and anode electrolyte circulation system (8). It should be understood that reference character (8) is used to refer to the anode electrolyte circulation system as a whole by pointing separately to various selected sub-components of the system.

The electrolyte agitation through the anode space is regulated by pump or valve by how much of electrolyte is withdrawn through the bottom drain in various exemplary embodiments. Electrolyte overflow is directed inside the tank or over the special inner wall located inside tank (19) is various exemplary embodiments. Such embodiments are believed to help maintain a constant electrolyte level and concentration of electrolyte inside the plating tank. This in turn is believed to help collect and distribute electrolyte evenly throughout the tank's volume.

It should be understood that the wall depicted in FIG. 1 is optional. Thus, other embodiments save space inside the plating tank by excluding the wall.

Anode circulation electrolyte flow is pumped out by the pump through a bottom intake combined in anode circulation system (8). Pump intake (5) and pump agitation system (8) have one pump, two pumps, or even more pumps in various exemplary embodiments. Some embodiments do not include a special anode agitation pump. Other exemplary embodiments include a special anode agitation pump located inside the plating tank, inside any compartment, inside an overflow compartment segregated from main tank by a wall or inside or connected to a special electrolyte storage and agitation tank separate from the main plating tank and containing an additional volume of electrolyte.

FIG. 2 is a partially schematic, partially cross-sectional view of a second exemplary embodiment of a plating apparatus with direct electrolyte distribution system.

In various exemplary embodiments, the electrolyte agitation pumps as well as the whole electrolyte circulation systems (5, 7, 8) are placed inside or outside the plating tank with an additional electrolyte collecting and storing system providing an extra volume of electrolyte to be stored and agitated. Direct flow and the electrolyte distribution compartment are thus unified with the anode compartment, and have the ability to be adjusted inside the plating tank to accommodate the thickness of the plated part. Such embodiments are believed to provide improved agitation inside the part as well as improved electrolyte flow.

Various exemplary embodiments including such an adjustable system (not shown) use flexible tubing or piping system similar to piping system (7) to provide a steady electrolyte flow without requiring the agitation line to be disassembled. Also, in various exemplary embodiments, electrolyte distribution nozzles (2) are removable to provide greater electrolyte flow to the surface of the part.

In various exemplary embodiments, the main electrolyte distribution compartment is separate from the anode with its independent adjustment. As depicted, the electrolyte distribution compartment has a special diaphragm (10) with a perforated wall or, as depicted, a removable screen (11). These features provide electrolytic contact with anode material outside the electrolyte distribution compartment or in a separate anode compartment. Accordingly, embodiments including these features don't interrupt plating process by shading the plated part as the cathode from the anode.

FIG. 3 is a partially schematic, partially cross-sectional view of a third exemplary embodiment of a plating apparatus with direct electrolyte distribution system. FIG. 4 is a partially schematic, partially cross-sectional, fragmented view of the third exemplary embodiment of a plating apparatus with direct electrolyte distribution system according to FIG. 3.

In various exemplary embodiments such as the embodiment depicted in FIG. 3 and FIG. 4, the electrolyte distribution compartment has an independent pump or pumps mounted inside this compartment providing independent distribution of electrolyte for each side of the plated part or parts. Suction section (4) of pump (5) is shown connected with main circulation drain of anode section (7) located at or near the bottom of anode compartment.

In various exemplary embodiments including using disposable electrode (6), anode electrolyte enriched with dissolved ions is vacuumed through pump intake (5) and pumped inside electrolyte distribution compartment (3) providing fresh enriched or pre-blended electrolyte evenly distributed into the part to be plated (1). A small portion of the electrolyte under excessive pressure is pushed through the membrane or cloth diaphragm (10) at the back of the electrolyte distribution compartment. The membrane or cloth diaphragm (10) is shown supported by perforated screen (11). The main portion of the electrolyte will be pushed under pump pressure through specially configured nozzles (2) directly into the part or parts to be plated for electrolyte distribution.

In various exemplary embodiments, including the depicted embodiment, the electrical contact is provided by specially designed anode (15) and cathode (13) contact systems. In various exemplary embodiments, these have special provisions or systems for the part's mounting (14). In various exemplary embodiments, these systems are steady or provide the part's movement during, before, or after, being plated.

In various exemplary embodiments, the electrolyte tank (19) has an outside wall. In some such embodiments, the wall exceeds in height the main electrolyte level to avoid overflow and spillage with overflow drainage system (16). Overflow drain system is connected with the main electrolyte circulation flow in various exemplary embodiments.

In various exemplary embodiments, the part's supporting and mounting system has a base designed independently or as an integral part of the main apparatus for flexibility and simplicity of design. In various exemplary embodiments, the connections between the compartment and between the pumps, filter and sediment traps 21, electrolyte heat exchanger 20, etc., located inside and/or outside of the electrolytic tank are made with any non-reactive material providing enough flexibility for parts and compartments moving and adjustment.

In various exemplary embodiments, the nozzles are removable to provide improved electrolyte distribution to the part. Likewise, in various exemplary embodiments, the nozzles are mounted on the front wall of the distribution compartment. Likewise, in various exemplary embodiments, nozzles are replaceable by any form of replacements or even plugs to change electrolyte direction or inner pressure inside distribution compartment.

In various exemplary embodiments, nozzles are placed on the distribution compartment into pre-formed holes by screwing in or pressing in at a designed combination. Nozzle combinations are flexible in various exemplary embodiments. This provides effective plating and electrolyte distribution to the part.

Figure 7:
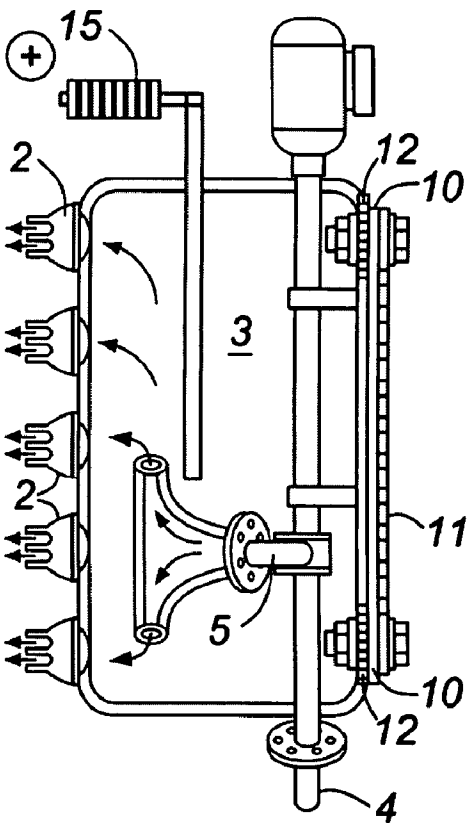
FIG. 7 is a partially schematic, partially cross-sectional view of a third exemplary embodiment of an anode contact system for use in a plating apparatus with direct electrolyte distribution system.
Figure 6:
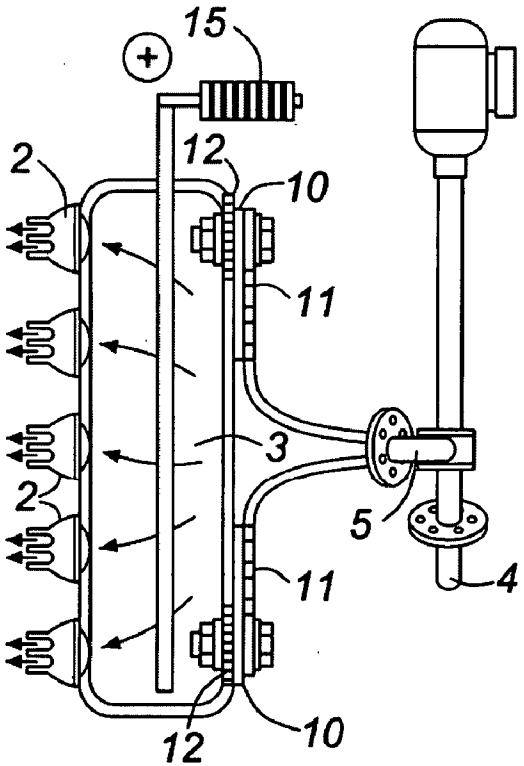
FIG. 6 is a partially schematic, partially cross-sectional view of a second exemplary embodiment of an anode contact system for use in a plating apparatus with direct electrolyte distribution system.
Figure 5:
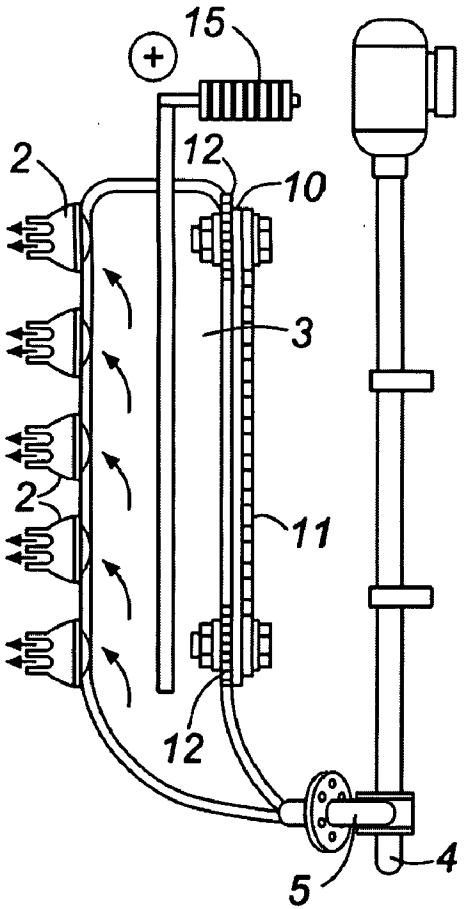
FIG. 5 is a partially schematic, partially cross-sectional view of a first exemplary embodiment of an anode contact system for use in a plating apparatus with direct electrolyte distribution system.

FIG. 5 is a partially schematic, partially cross-sectional view of a first exemplary embodiment of an anode contact system for use in a plating apparatus with direct electrolyte distribution system. FIG. 6 is a partially schematic, partially cross-sectional view of a second exemplary embodiment of an anode contact system for use in a plating apparatus with direct electrolyte distribution system. FIG. 7 is a partially schematic, partially cross-sectional view of a third exemplary embodiment of an anode contact system for use in a plating apparatus with direct electrolyte distribution system.

In various exemplary embodiments, an anode is placed into the plating tank behind the electrolyte distribution compartment, inside or outside the electrolyte distribution compartment, or at any place that provides satisfactory electrical contact and does not interfere with plating, electrolyte distribution or metal ions agitation and delivery to cathode. The position of the electrolyte agitation pump could varies according to various exemplary embodiment, including as shown in FIG. 5, FIG. 6 and FIG. 7. Various exemplary embodiments, including those depicted, provide negative pressure electrolyte intake outside the distribution compartment, or even outside the outer tank, directing electrolyte with high pressure inside of the electrolyte compartment and through specially designed nozzles to evenly distribute plating solution to the part or parts to be plated.

According to the foregoing, various exemplary embodiments using higher current density increase plating process speed by at least 50%. Likewise, various exemplary embodiments plating directly on the bottom of housing reduce plating costs by 20-25%. This is particularly true of embodiments that use less metal on unimportant surfaces and accordingly reduce labor.

According to the foregoing, various exemplary embodiments provide direct controlled distribution of electrolyte with preferable plating velocity at controlled areas of a part or parts to be plated. The direct distribution system increases the effectiveness of plating process and improves plating thickness distribution over the part's variable level of surface. This includes any part manufactured by machining, cast, stamping, powder metallurgy and ceramic sintering methods or made by any other metal forming or pressing process.

The direct distribution of electrolyte is provided, in various exemplary embodiments, by a special compartment with a connected pump. In various exemplary embodiments, the compartment has nozzles on one side and a membrane for electrolyte flow and electrical contact with anode or anode compartment on the opposite side. The membrane is supported by a perforated screen so electrolyte distribution and anode compartments or anode are connected by electrolyte for continuous and controlled solution flow.

In various exemplary embodiments, nozzles are placed on the high-pressure side of the electrolyte distribution compartment to direct electrolyte to exact areas to be plated. In various exemplary embodiments, nozzles can be removed, replaced, closed or blocked to provide improved electrolyte distribution to the part's surface. Electrolyte distribution therefore will replicate the surface of part to be plated in an improved manner. In various exemplary embodiments, the electrolyte distribution compartment is adjustable to acquire the part's thickness, and surface details provide improved electrolyte flow to the part or parts.

In various exemplary embodiments, the electrolyte distribution compartment is combined with the anode or with the anode compartment. Such embodiments provide independent electrolyte flow through or near the anode. The anode filling material is placed inside the compartment in various exemplary embodiments having a disposable anode.

In various exemplary embodiments, the electrolyte distribution compartment is segregated from the anode. Such embodiments provide improved flexibility for electrolyte flow adjustment inside the plating tank.

In various exemplary embodiments, the electrolyte distribution system includes an outside tank for electrolyte storage, cooling, filtering and effective circulation. Similarly, various exemplary embodiments include a separate circulation system for the anode compartment.

In various exemplary embodiments, the part's mounting system is independent from the electrolyte distribution system. Similarly, various exemplary embodiments include electrical contact arrangements necessary for the part's electrical plating.

In various exemplary embodiments, the anode compartment has electrical contact with the opposite polarity (positive) from the cathode (part's) polarization connected to an electrical source with regulated voltage or current. Such embodiments are believed to be desirable for electro-less plating or chemical coating where the electrical contact might be deactivated or removed.

According to the foregoing, various exemplary embodiments have the advantage of the system with direct electrolyte distribution system being flexible and enabling improved process adjustment to the part's shape, depth of details providing improved and controlled plating and even distribution of deposited ions to the plated surface of cathode (plated part). Various exemplary embodiments enable the immediate removal of electrochemical or chemical reaction products. Various exemplary embodiments include a double electrical layer near the cathode that is adjustable to minimize it, at the same time increasing the current density above the level that could limit ions distribution and slow the metal deposition reaction. Likewise, various exemplary embodiments reduce or eliminate areas with gas or air pockets, and reduce or eliminate discharging metal concentration directing plating process to areas where plating is most desired.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A plating apparatus with a direct electrolyte distribution system, comprising:

an electrolyte tank;

an electrolyte distribution compartment, within the electrolyte tank, wherein the electrolyte distribution compartment contains electrolyte, has both a first side and a second side, and the first side is opposite the second side;

a pump having a fluid connection to the first side of the electrolyte distribution compartment;

a plurality of nozzles connected between the pump and the first side of the electrolyte distribution compartment;

an electrolyte collection compartment, within the electrolyte tank, the electrolyte collection compartment being in fluid communication with the electrolyte distribution compartment; and a removable screen, within the electrolyte tank, located between the electrolyte collection compartment and the second side of the electrolyte distribution compartment.

2. The plating apparatus with the direct electrolyte distribution system, according to claim 1, further comprising:

a drain in the electrolyte collection compartment.

3. The plating apparatus with the direct electrolyte distribution system, according to claim 1, further comprising:

perforations in the electrolyte collection compartment, said perforations between the electrolyte in the electrolyte collection compartment and the removable screen.

4. The plating apparatus with the direct electrolyte distribution system, according to claim 3, further comprising:

a diaphragm between the perforations and the removable screen.

5. The plating apparatus with the direct electrolyte distribution system, according to claim 4, wherein the diaphragm is a cloth membrane.

6. The plating apparatus with the direct electrolyte distribution system, according to claim 3, wherein the perforations in the electrolyte collection compartment are on a removable sheet.

7. The plating apparatus with the direct electrolyte distribution system, according to claim 6, wherein the removable sheet having the perforations in the electrolyte collection compartment is not conductive.

8. The plating apparatus with the direct electrolyte distribution system, according to claim 1, wherein the removable screen is perforated.

9. The plating apparatus with the direct electrolyte distribution system, according to claim 1, further comprising:

a rack that holds a part to be plated.

10. The plating apparatus with the direct electrolyte distribution system, according to claim 9, wherein the rack is in a fixed position.

11. The plating apparatus with the direct electrolyte distribution system, according to claim 9, wherein the rack is movable.

12. The plating apparatus with the direct electrolyte distribution system, according to claim 11, wherein the rack includes at least one feature selected from a list consisting of wheels, rollers, mechanical rails, a conveyor belt, and electrical contact rails.

13. The plating apparatus with the direct electrolyte distribution system, according to claim 11, wherein the rack is an in and out monolith.

14. The plating apparatus with the direct electrolyte distribution system, according to claim 11, wherein movement of the rack is automatic.

15. The plating apparatus with the direct electrolyte distribution system, according to claim 11, wherein movement of the rack is manual.

16. The plating apparatus with the direct electrolyte distribution system, according to claim 1, further comprising:

a heat exchanger that heats the electrolyte.

17. The plating apparatus with the direct electrolyte distribution system, according to claim 1, further comprising:

a filter that traps sediment in the electrolyte.

18. The plating apparatus with the direct electrolyte distribution system, according to claim 1, further comprising:

an overflow drainage system that drains excess electrolyte away from the electrolyte tank.

19. The plating apparatus of claim 1, wherein both a conductive metal plate and a perforated non-conductive plate separate the electrolyte collection compartment and the second side of the electrolyte distribution compartment.

20. The plating apparatus of claim 1, further comprising:

an overflow compartment segregated from the electrolyte tank.

* * * * *